US006834707B2

(12) United States Patent
Holzgruber et al.

(10) Patent No.: US 6,834,707 B2
(45) Date of Patent: Dec. 28, 2004

(54) METHOD AND APPARATUS FOR THE CONTINUOUS PRODUCTION OF CAST OR REMELTED BILLETS USING AN ELECTROSLAG METHOD

(75) Inventors: Harald Holzgruber, Bruck a.d. Mur (AT); Wolfgang Holzgruber, Bruck a.d. Mur (AT); Bertram Ofner, Kapfenberg (AT)

(73) Assignee: Inteco Internationale Technische Beratung Ges.m.b.H. (AT)

( * ) Notice: Subject to any disclaimer, the term of this patent is extended or adjusted under 35 U.S.C. 154(b) by 165 days.

(21) Appl. No.: 10/347,995

(22) Filed: Jan. 21, 2003

(65) Prior Publication Data

US 2003/0111204 A1 Jun. 19, 2003

Related U.S. Application Data

(62) Division of application No. 09/980,141, filed on Nov. 29, 2001, now Pat. No. 6,568,463.

(30) Foreign Application Priority Data

Jun. 8, 1999 (AT) ..... 1009/99

(51) Int. Cl.[7] ..... B22D 11/128; B22D 27/02

(52) U.S. Cl. ..... 164/263; 164/441; 164/442; 164/509

(58) Field of Search ..... 164/263, 460, 164/441, 442, 509, 484, 497, 470

(56) References Cited

U.S. PATENT DOCUMENTS 6,568,463 B1 * 5/2003 Holzgruber et al. ..... 164/484

* cited by examiner

*Primary Examiner*—Kiley S. Stoner
*Assistant Examiner*—I.-H. Lin
(74) *Attorney, Agent, or Firm*—Bachman & LaPointe, P.C.

(57) ABSTRACT

The invention relates to a method and the apparatus required for carrying out the method for the continuous production of billets or ingots of metals, in particular steels and Ni- and Co-base alloys using the method of electroslag remelting and electroslag continuous casting in downwardly open water-cooled ingot molds, in which the billet issuing downwardly from the ingot mold is pressed against at least one guide element arranged rigidly in respect of its position with respect to the ingot mold axis, by at least one clamping element arranged opposite the guide element, in such a way that the regions of the billet surface which are in contact with the guide or clamping elements change within short intervals of time, wherein at least one of the elements is driven to withdraw the billet while the others move with the billet and a contact with a current source can be made by way of at least one of the elements.

5 Claims, 1 Drawing Sheet

METHOD AND APPARATUS FOR THE CONTINUOUS PRODUCTION OF CAST OR REMELTED BILLETS USING AN ELECTROSLAG METHOD

CROSS REFERENCE TO RELATED APPLICATION

This application is a divisional of U.S. patent application Ser. No. 09/980,141, filed Nov. 29, 2001, now issued as U.S. Pat. No. 6,568,463.

BACKGROUND OF THE INVENTION

The invention concerns a method for the continuous production of a billet or ingot of metal and an apparatus which is suitable for same.

The continuous production of blooms or billets using the method of electroslag remelting or electroslag casting is basically known.

Such a method with apparatus is to be found in JP-A-63 072 840; disposed beneath the ingot mold on both sides of the path of movement of the billet in mutually opposite relationship are clamping members, which are movable radially relative to the axis of the billet relative thereto, of clamping devices which are connected to the current source of the ingot mold. The billet is drawn off downwardly with those clamping members.

Sh. Sasayama et al describe a method for the continuous remelting of self-consumable electrodes using the electroslag remelting method in a water-cooled ingot mold with continuous billet withdrawal by a draw-off apparatus.

Continuous production of remelted billets is made possible by use of the electrode change technology and cutting of the billets produced of small dimensions in the installation, in which respect the remelting rates for casting cross-sections of 130–250 $mm^2$ are specified at 180–275 kg/h and thus range in the area of 1.1–1.38 kg/h/mm billet thickness.

A. E. Vokov et al describe a continuous method for melting grinding dust in a slag bath heated by a non-consumable electrode in a water-cooled ingot mold with continuous billet withdrawal by a so-called bloom, clamping and draw-off apparatus. An autogenous cutting apparatus arranged in the installation permits the remelted billets produced to be cut to length. The remelting rates are specified at 210–240 kg/h for billets of a 300 mm diameter and are accordingly 0.7–0.8 kg/h/mm billet diameter.

AT 399 463 B discloses a method of electroslag continuous casting of steels and alloys, in which the casting surface in the water-cooled ingot mold is covered by an electrically conductive slag and in which the slag bath is heated for example when current passes therethrough by auxiliary electrodes which dip thereinto. In that method the casting speed is said to be so set that it is at least 1.5 times the melting-away rate which is usual in an electroslag remelting procedure and at most 50% of the casting speed in the case of conventional continuous casting. There is no information about the way in which the billet is withdrawn.

U.S. Pat. No. 5,799,721 discloses a method of electroslag billet melting of metals, in which self-consumable electrodes whose cross-sectional area is 0.5 times the cross-sectional area of the remelting billet are remelted at a melting-away rate in kg/h, which corresponds to between 1.5 and 30 times the equivalent billet diameter calculated from the periphery of the casting cross-section, in accordance with $D_{eq}=U/\pi$ in mm. There is also no information about the way in which the billet is drawn off.

On the other hand, very different arrangements are known for continuously drawing off the billets, for the continuous casting of steels and alloys, in which respect those apparatuses are always arranged at a considerable spacing from the water-cooled ingot mold and a secondary cooling section is generally disposed between the water-cooled ingot mold and the billet draw-off apparatus.

In the case of so-called arc installations the billet draw-off apparatus also has to perform the function of a continuously operating bending and straightening installation.

Draw-off apparatuses for continuously operating electroslag installations however must additionally also be in a position to carry away either all or at least a part of the melting current from the billet produced, without any interruption, in which respect consideration is to be paid to guiding the billet which is being drawn off, at a small spacing from the lower edge of the ingot mold.

Contact with a current source can basically be made with the clamping apparatuses referred to in the literature.

Both roller elements and also movable clamping jaw systems are known for the purposes of drawing off the billet. Roller elements enjoy the advantage that, when the billet is moving, the contact locations with the surface of the billet continuously change so that inadmissible cooling of the surface of the billet is avoided, even when using water-cooled rollers. On the other hand, taking off the melting current by way of rollers is admittedly possible by using brushes, but it is not entirely simple to implement that when higher current strengths are involved.

In contrast, in regard to taking off the current, clamping jaws with a relatively short stroke movement enjoy advantages as a fixed current-conducting connection is comparatively simple to make by using flexible line elements such as cables or bands. On the other hand clamping jaws which move with the billet in the draw-off movement thereof are in constant contact with the surface of the billet during the clamping phase so that, in a long clamping phase, unacceptable cooling of the surface of the billet can be caused at the contact locations. For that reason, the engagement times of clamping jaw elements may not be selected to be too long, in which respect it can be helpful, similarly as in the case of forging tools, to allow a certain rise in temperature of the clamping jaw contact surface.

SUMMARY OF THE INVENTION

In consideration of that state of the art the inventor set himself the aim of simplifying the known methods and apparatuses, avoiding the disadvantages noted.

That object is attained by the teaching of the independent claim; the appendant claims set forth advantageous developments. The scope of the invention also embraces all combinations of at least two of the features disclosed in the description, the drawings and/or the claims.

In the method according to the invention, the billet issuing from the ingot mold is pressed against at least one guide element which is arranged rigidly in respect of its arrangement with respect to the ingot mold axis and which is in the form of roller elements comprising one or more rollers by at least one clamping element which is arranged in opposite relationship thereto in such a way that the contact points of the surface of the billet and the guide or clamping element continuously change, wherein at least one of those elements is driven for the purposes of drawing off the billet while the other moves with the movement of the billet and contact with a current source can be made at least by one of said elements.

It has proven to be desirable for the billet issuing from the ingot mold to be pressed against one or more rollers, the axes of which are arranged at 90° relative to the axis of the billet. In addition, the billet is to be drawn off by at least one roller against which the billet is pressed being driven.

The melting current is advantageously taken off by way of the clamping jaws which can be alternately pressed against the billet, in which respect the pressing times of the individual jaws do not exceed two minutes.

In order to keep short the contact times of the clamping jaws with the surface of the billet, the clamping jaws can preferably also be in the form of swing or rocking jaws which, similarly to a roller of large radius, roll along the surface of the billet during the clamping cycle.

The billet draw-off movement can be effected by one or more driven rollers or also by at least two clamping jaws of which one is always pressed against the billet and at the same time the draw-off movement is produced by a suitable device, while the second jaw is withdrawn and is returned to its upper position, i relation to the billet draw-off movement.

In that situation, the rollers which are not driven or the clamping jaws which are pressed against the billet also move with the draw-off movement of the billet, in which case the non-driven roller can be in the form of a measuring roller.

An apparatus suitable for carrying out the method according to the invention comprises a rigid frame which is aligned in relation to the axis of the ingot mold and which has at least two water-cooled guide rollers of which at least one is driven, and at least two clamping jaws which are connected to a current source and which can be pressed against the surface of the billet.

BRIEF DESCRIPTION OF THE DRAWINGS

Further advantages, features and details of the invention will be apparent from the description hereinafter of a preferred embodiment and with reference to the drawing in which the single FIGURE is a diagrammatic view in longitudinal section through an apparatus according to the invention.

DETAILED DESCRIPTION OF THE PREFERRED EMBODIMENT(S)

Figure 1:
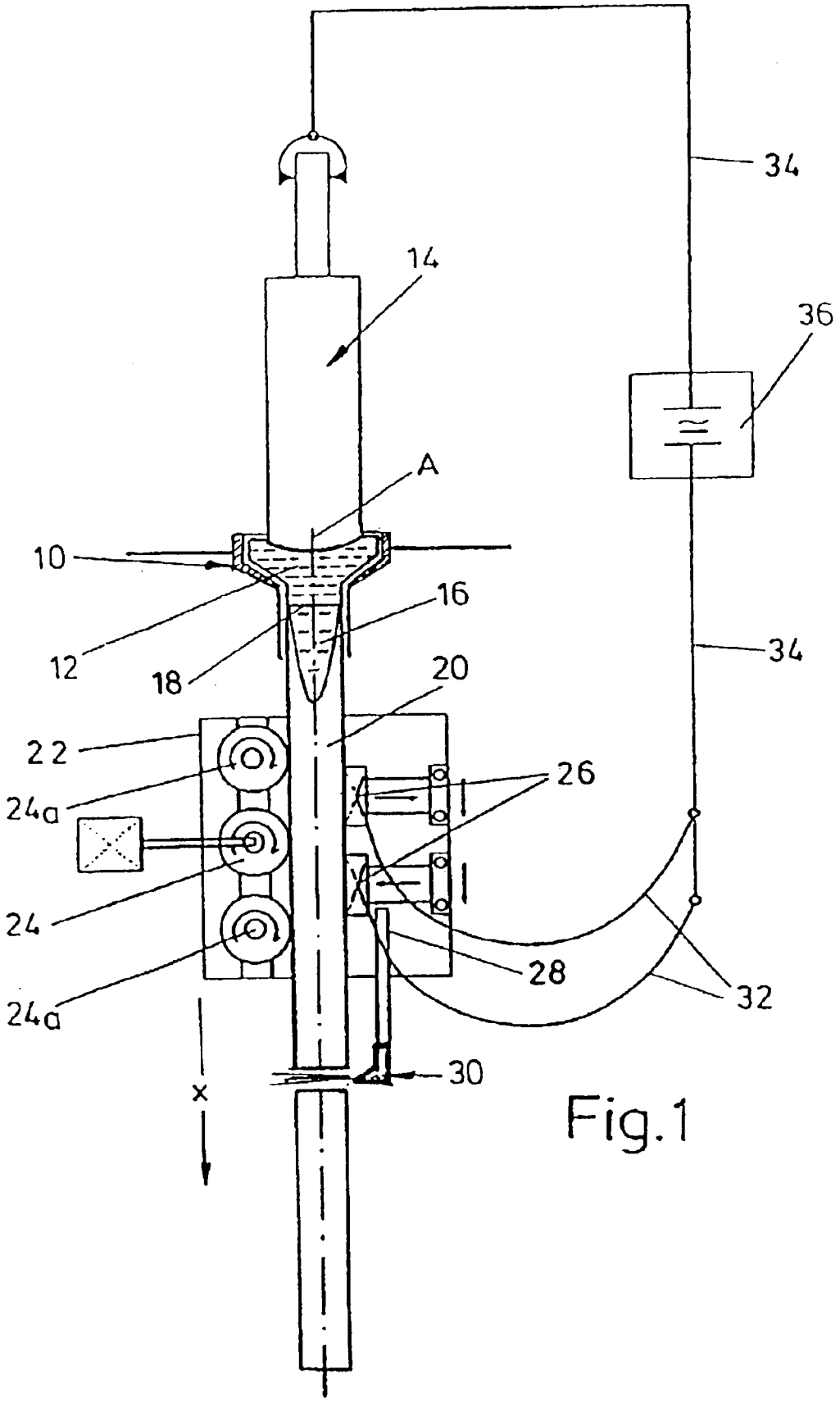

Disposed in a water-cooled ingot mold 10 which can also be in the form of a per se known funnel ingot mold is a slag bath 12 in which a self-consumable electrode 14 is being melted down. The melted-down metal is collected in a melting sump 16; the surface of the molten metal therein is identified by reference 18.

A billet 20 which is formed after setting a drawn off downwardly from the ingot mold 10 in the direction x by a driven roller 24 which is arranged in a rigid frame 22, in relation to the axis A of the ingot mold. Guidance for the billet 20 in parallel relationship to the axis A of the ingot mold is afforded by the above-mentioned driven roller 24 and further rollers $\mathbf{24}_a$, against which the billet 20 is pressed alternately by one of two clamping means 26 which are displaceable in a vertical direction.

A holding device 28 for the lower one of the two clamping means 26 carries an autogenous flame cutting device 30 with which the billet 20 produced can be cut to length in the phase of engagement of the clamping means 26. The clamping means 26 are connected to a current source 36 by way of flexible cables 32 and high-power lines 34.

In a particularly advantageous embodiment the jaws of the clamping means 26, which jaws are pressed alternately against the billet, are in the form of swing or rocking clamping jaws, the axes of which are arranged in the rigid frame 22 in such a way that the clamping means 26 are movable in the draw-off direction x and their surface which is in contact with the billet 20 has a curvature with a radius corresponding to their axis spacing so that it rolls along the surface of the billet, in the condition of being pressed thereagainst.

As soon as the second swing clamping jaw is in engagement and therefore pressed against the billet, the jaw is retracted from the surface of the billet and the swing or rocking member is moved about the axis in opposite relationship to the billet draw-off direction into an upper starting position where it remains until the jaw is again pressed against the surface of the billet.

What is claimed is:

1. Apparatus comprising an ingot mold, with at least one clamping device arranged downstream thereof, said at least one clamping device being in contact with a current source, at least two rollers forming guide elements, said at least two rollers being arranged parallel to an axis of the ingot mold in a frame and being rotatable in a draw-off direction, at least one clamping element being arranged in opposite relationship thereto and being pressed against a billet in a direction of the guide elements, said at least one clamping element being movable in the direction of the axis of the ingot mold both in a condition of being pressed against the billet and also in a released condition, and one of the guide elements being driven.

2. Apparatus as set forth in claim 1, wherein said at least one clamping element comprises clamping jaws which are displaceable in the direction of an axis of the billet in opposite relationship to the rollers.

3. Apparatus as set forth in claim 1, further comprising a rigid frame for receiving the rollers and the at least one clamping element which is in opposite relationship at the other side of the billet.

4. Apparatus as set forth in claim 1, further comprising the at least one clamping element being in the form of swing jaws whose contact surface with a surface of the billet has a curvature whose radius corresponds to a spacing from a swing axis.

5. Apparatus as set forth in claim 1, further comprising two clamping elements connected to the current source and one of the clamping elements remote from the ingot mold being provided with an autogenous flame cutting device.

* * * * *